United States Patent [19]

de Waltoff

[11] 3,971,861

[45] July 27, 1976

[54] ALLOY PLATING SYSTEM

[75] Inventor: Lionel de Waltoff, La Prairie, Canada

[73] Assignee: Handy Chemicals Limited, La Prairie, Canada

[22] Filed: Oct. 25, 1974

[21] Appl. No.: 518,170

[52] U.S. Cl. ..... 427/247; 106/1; 427/427; 427/438; 162/DIG. 1

[51] Int. Cl.[2] ..... C23C 3/02

[58] Field of Search ..... 427/438, 304, 305, 306, 427/142, 247; 106/1; 162/DIG. 1, 348, 199

[56] References Cited

UNITED STATES PATENTS

| | | | |
|---|---|---|---|
| 2,929,742 | 3/1960 | De Minjer et al. | 427/438 |
| 3,265,511 | 8/1966 | Sallo | 106/1 |
| 3,281,266 | 10/1966 | Colonel | 427/438 |
| 3,338,741 | 8/1967 | Katz | 427/438 |
| 3,485,597 | 12/1969 | Pearlstein | 427/438 X |
| 3,489,576 | 1/1970 | Vincent et al. | 427/438 |
| 3,767,369 | 10/1973 | Barlow et al. | 427/438 X |

FOREIGN PATENTS OR APPLICATIONS

| | | | |
|---|---|---|---|
| 1,009,890 | 11/1969 | United Kingdom | 162/DIG. 1 |

*Primary Examiner*—Ralph S. Kendall

[57] ABSTRACT

Electroless deposition of tin-nickel alloys is carried out using a plating solution containing a tin salt, a nickel salt and thiourea. The solution is particularly useful for spray or immersion plating of bronze Fourdrinier screens.

9 Claims, No Drawings

ALLOY PLATING SYSTEM

This invention relates to the electroless deposition of tin-nickel alloys.

For many years, the paper industry has been faced with the problem of rapid deterioration of the Fourdrinier wire screens employed in the paper making process. These screens are normally made of bronze or another copper based alloy and have generally afforded a working life of the order of from 3 to 5 days, before requiring repair or replacement. In addition, the down time required for replacement of the screens naturally involved interruption of the paper making process and increased the overall cost of the operation by a significant factor. Because of rising costs in all aspects of paper making, manufacturers have been turning towards the use of synthetic organic polymer screens which last considerably longer than the wire screens but present different problems of equal magnitude, namely high cost of initial equipment; greater power requirements, problems of removing pulp residues from the synthetic screens, and poor drainage of water. It will be clearly apparent that, if the life of a wire screen could be extended by a factor of 10 to 20 times its current average working life by an economical and readily accomplished manner, it would be of great practical and economical value to the paper making industry.

It is an object of the present invention to provide a means of achieving an improvement of screen life, by electroless deposition of a tin-nickel alloy coating on worn screens.

According to one aspect of the present invention, there is provided an electroless plating solution comprising an aqueous solution of a nickel salt, a tin salt and thiourea.

In one embodiment, the bath also contains iodide ions, or a portion of the thiourea is replaced by iodide ions. The bath may also contain various additional conventional ingredients, for example hypophosphite, ammonium chloride, and alkali for adjusting the pH to the mildly acidic range.

Another aspect of the invention provides a method of alloy plating a tin-nickel alloy on a metallic substrate, preferably copper or copper base alloy, which comprises electroless coating the alloy on the substrate from an aqueous solution containing a tin salt, a nickel salt and thiourea and having a pH value in the mildly acidic range, preferably from about 2 to 4.

Generally speaking, the solution of the invention can be employed with a variety of metal substrates and without the need for prior pre-activation of the substrate by means of flash coating of palladium or of gold or resort to an external source of electrical potential to initiate the reaction. Preferred substrates for which good results have been achieved include copper and copper alloys such as bronze. For other substrates such as iron, steel, zinc, zinc alloys and aluminum, it is desirable for the plating solution to contain iodide ions. An aluminum substrate requires pretreatment in a standard zincate bath.

The pH value of the bath is of some importance to the performance and should be maintained in the mildly acidic range, preferably in the range of about 2 to 5, more preferably about 2.5 to 4.0. The temperature also affects the plating efficiency and rate and best results have been obtained at elevated temperatures, preferably from about 100° to 190°F.

The plating solution of the invention contains a nickel salt and a tin salt, as mentioned above, and the concentrations of each of these ingredients are advantageously from about 0.25 to 5% by weight of the solution, based on nickel or tin, respectively, more preferably from about 0.5 to 2% by weight. Naturally, the relative proportions of these salts in the solution can be varied depending on the desired composition of the plated alloy. Thus, depending on the required properties of the deposited coating as to ductility, hardness, corrosion resistance, etc., the plating bath composition can be appropriately adjusted so as to plate an alloy predominating in either tin or nickel.

Additionally, the ratio of tin to nickel in the plated alloy can be adjusted by varying either the temperature or the pH value of the plating solution or both. Thus, at constant temperature, lowering the pH from about 3.5 to the range of 2.5–2.7 results in a larger proportion of tin in the alloy deposit. Alternatively, at a constant pH value, as the plating temperature increases, the proportion of nickel in the plated alloy will also increase.

By these expedients, as well as by varying the initial bath composition, a considerable measure of control can be exerted on the final alloy composition so as to provide a desired set of properties in the plated alloy. For example, if a drawing operation is to be performed, the solution could be adjusted to a relatively low pH value, e.g. 2.7–3.0 and relatively more tin will be present in the plated alloy to afford greater lubricity during the drawing step. Alternatively, if for example corrosion resistance to sulfuric acid is required, raising the pH to 3.5 and the plating temperature to 180°–190°F. will increase the nickel content to about 50% and afford a plated alloy having high resistance to sulfuric acid-containing environments. Intermediate physical and chemical properties are achieved by maintaining the pH value at 3–3.5 and operating at a temperature in the range of 140°–180°F.

The nature of the nickel salt and the tin salt is not particularly critical and any water soluble salt, including any conventional tin or nickel and electrolyte, such as nickel sulfate, nickel chloride and stannous sulfate may be employed.

Other alloys can also be deposited from the thiourea plating baths of the invention, including ternary and quaternary alloys systems, such as nickel-tin-zinc, nickel-tin-chromium, copper-nickel-tin and lead-tin-copper-nickel alloys. The plating solution in each case is simply modified by the inclusion of appropriate soluble salts, such as acetates, chlorides or nitrates, in addition to the thiourea.

Basically speaking, thiourea constitutes an essential ingredient of the plating solution of the invention. It has been described in the literature (J. Kivel and J. S. Sollo, Journal of the Electrochemical Society, December 1965, pages 1201–1203) that more than a few parts per million of thiourea completely terminates deposition in electroless nickel plating systems. We have now surprisingly found that the use of substantial amounts of thiourea, 1% by weight up to the saturation level, plus control of pH value, permits electroless plating of adherent coatings of tin-nickel alloys.

If iodide ions are to be included in the plating solution, this can readily be accomplished by the use of a soluble iodide, such as potassium or ammonium iodide. An amount of iodide equal to at least twice the weight percent of thiourea is preferred. This can be present in addition to the thiourea or in replacement of a portion thereof. Thus, the amount of thiourea can be reduced to approximately 1% by weight of the solution, by the addition of at least 2% by weight of the iodide. Greater amounts of iodide up to saturation are not detrimental to plating performance.

The plating can be accomplished by any conventional electroless method, for example by means of immersion, roller coating, spray coating or a combination of such methods. The deposit thickness can be varied as desired by control of the plating time, the pH value or the plating temperature, or by a combination of these factors. The resulting coatings of tin-nickel alloy are both adherent and stable and exhibit high resistance to spontaneous decomposition.

The plating bath of the invention is particularly useful in the repair of Fourdrinier screens. Thus, as mentioned above, conventional screens are subject in use to rapid deterioration and have a life expectancy of from 3 to 5 days. By the use of the electroless coating solution of the invention, the bronze wires of a Fourdrinier screen can be restored by electroless coating to deposit a layer of tin-nickel alloy thereon. If desired, the coating step can be carried out, for example by spray coating, with the screen in situ on the machine, thereby eliminating the time normally required for dismantling the screens and replacing them. As a consequence, a screen can be repaired several times, so that its working life may be extended by a factor of up to approximately 10 to 20 times.

The tin-nickel coatings achieved by the use of the plating solutions of the invention exhibit high corrosion resistance and unusual chemical stability over a wide range of temperature and pH. Moreover, the plating solution of the invention is capable of tolerating the presence of relatively large amounts of contaminants, in contrast to most conventional electroless plating solutions. Naturally, in a paper making environment, the likelihood of contamination of the solution by chemicals used in the paper making process is relatively high and the ability of the plating solution of the invention to continue to function notwithstanding the presence of such impurities and contaminants is of major practical importance.

It will be appreciated that the invention is applicable to electroless plating of a wide variety of articles and parts, particularly those formed of or already coated with copper or a copper alloy. Naturally, an article or part formed of any other metal can first be coated with copper and then subjected to electroless plating according to the invention, or can be directly plated if the bath contains iodide ions.

The following Examples illustrate the invention.

EXAMPLE 1

Two 1500 ml Pyrex beakers were placed in a constant temperature water bath with varying temperature control and two 1000 gm solutions A and B were made up with the following composition in wt. percent:

Solution A

| | |
|---|---|
| $NiSO_4\ 6H_2O$ | 4.20 |
| Stannous sulfate ($SnSO_4$) | 0.84 |
| Hydroxy acetic acid ($HOCH_2COOH$) | 2.93 |
| Sodium hypophosphite ($NaH_2PO_2.H_2O$) | 2.93 |
| Thiourea ($H_2NCSNH_2$) | 2.93 |
| Ammonium chloride ($NH_4Cl$) | 1.11 |
| NaOH (50%) | 1.26 |

-continued

| | |
|---|---|
| Water (balance) | 83.80 |

Solution B

As solution A except that thiourea was omitted.

In each case, the amount of NaOH was that required to adjust the pH value to 3.5. The solutions were poured into the two beakers which were marked A and B, respectively, and placed in the constant temperature bath, the temperature being adjusted to 100°F. Specimens of bronze wire (4 inches ×4 inches) screen were cleaned in a mild alkaline cleaner, rinsed in cold water, deoxidized in 10N HCl, and again rinsed in cold water. The prepared specimens were then placed in the solutions for a period of ten minutes. Subsequent examination of the specimens showed that the specimen placed in solution A was coated with a uniform silvery deposit while the specimen from solution B appeared slightly discoloured but showed no evidence of a coating, which fact was later confirmed by analysis. The experiments were repeated varying the temperature over the range 100° to 190°F and the pH value over the range 2 to 4. Regardless of these variations, no plating was achieved with solution B, while in each case solution A resulted in deposition on the bronze wire screen.

Thiourea was then added to a portion of solution B and a specimen of bronze wire screen was immersed therein. After 10 minutes, the specimen was removed and it was observed that plating had taken place.

Further experiments were performed with solution A by maintaining the temperature constant at 100°F and lowering the pH value from the initial 3.5 to the range of 2.5–2.7 by the addition of hydroxyacetic acid. Analysis of the plated coating obtained showed the presence of a larger percentage of tin therein. Additionally, specimens were plated in solution A at pH 3.5 and at different temperatures over the temperature range of 100°F to 190°F and it was noticed that as the plating temperature increased, the proportion of tin in the alloy coating decreased. The results of these experiments are summarized in the following Table.

TABLE

Plating from solution "A" at various temperatures and pH values - approximate wt % Sn in alloy coating

| | pH Value | | |
|---|---|---|---|
| | 3.0 | 3.5 | 4.0 |
| 100°F | >80 | 77 | 65 |
| 150°F | 60 | 50 | <50 |
| 190°F | 60 | 45 | 42 |

The above laboratory experiments were repeated on a production scale using 50 gallon quantities of solution and 4 feet × 4 feet bronze screens and copper sheet. The results paralleled those obtained in the laboratory.

In all experiments, depending on the temperature and pH value, small amounts of phosphorous and minute amounts of sulfur were deposited in the alloy coatings, but did not appear deleteriously to effect the quantity thereof.

EXAMPLE 2

Potassium iodide was added to solution A in amounts of at least twice the weight percent of thiourea, an equivalent amount of water being subtracted to achieve 100% by weight formula. Conditions of plating were as follows. Coupons of steel, zinc, and aluminum were cleaned in a mild alkaline cleanser, rinsed in cold water, dipped in 5% $H_2SO_4$, water rinsed and plated. The aluminum was treated with standard zincate solution prior to plating.

The plating bath containing the potassium iodide was heated on a hot plate to 180°F and maintained at this temperature and at pH 3.5 throughout the plating cycle. The coupons of the various metals, namely steel, zinc, zinc die casting and pre coated aluminum were plated individually for 15 minutes then rinsed with water and dried. Specimens plated were well coated and the plated layer was adherent.

The embodiments of the invention in which an exclusive property or privilege is claimed are defined as follows:

1. In an aqueous electroless plating solution containing a nickel salt, a tin salt and a hypophosphite, the improvement which comprises including in said solution thiourea in an amount of at least 1% by weight up to the saturation concentration of thiourea and maintaining the pH value of the solution in the range of about 2 to 5.

2. A solution according to claim 1, wherein the nickel salt and tin salt are each present in a concentration of about 0.25 to 5% by weight of the solution, based on nickel and tin respectively.

3. A bath according to claim 2 wherein the pH value is from about 2.5 to 4.0.

4. A bath according to claim 2, wherein the nickel salt is nickel sulfate or nickel chloride.

5. A bath according to claim 2, wherein the tin salt is stannous sulfate.

6. A bath according to claim 2, and additionally containing a soluble salt selected from a lead salt, a copper salt, a chromium salt and a zinc salt.

7. A bath according to claim 2, and including a source of iodide ions.

8. A bath according to claim 7, wherein the source of iodide ions comprises a soluble iodide salt in an amount by weight of at least twice the amount of thiourea.

9. A method of restoring a worn bronze Fourdrinier wire screen which comprises contacting said screen with said electroless plating solution as defined in claim 1 and forming a tin-nickel alloy electroless plating on said screen.

* * * * *